US007717083B2

(12) United States Patent
Chen et al.

(10) Patent No.: US 7,717,083 B2
(45) Date of Patent: May 18, 2010

(54) DIESEL COMBUSTION MODE SWITCHING CONTROL BASED ON INTAKE CARBON DIOXIDE (CO2) CONCENTRATION

(75) Inventors: Qian Chen, Rochester, MI (US); Tim Chang, West Bloomfield, MI (US)

(73) Assignee: GM Global Technology Operations, Inc.

( * ) Notice: Subject to any disclaimer, the term of this patent is extended or adjusted under 35 U.S.C. 154(b) by 187 days.

(21) Appl. No.: 12/117,211

(22) Filed: May 8, 2008

(65) Prior Publication Data

US 2009/0056673 A1 Mar. 5, 2009

Related U.S. Application Data

(60) Provisional application No. 60/966,864, filed on Aug. 30, 2007.

(51) Int. Cl.
*F02B 17/00* (2006.01)
*F02B 5/00* (2006.01)

(52) U.S. Cl. ..... 123/295; 123/430

(58) Field of Classification Search ..... 123/295, 123/305, 430, 27 R, 434, 436, 568.11, 704; 701/103, 104, 108

See application file for complete search history.

(56) References Cited

U.S. PATENT DOCUMENTS

2008/0047523 A1 * 2/2008 Chen et al. ..... 123/295
2009/0118978 A1 * 5/2009 Tanabe et al. ..... 701/103

OTHER PUBLICATIONS

U.S. Appl. No. 11/466,902, filed Aug. 24, 2006, Qian Chen.

* cited by examiner

*Primary Examiner*—Mahmoud Gimie

(57) ABSTRACT

A method of switching a combustion mode of a diesel engine may include determining a carbon dioxide concentration in an intake manifold of a diesel engine, operating the diesel engine in a first combustion mode, and operating the diesel engine in a second combustion mode when the determined carbon dioxide concentration is greater than a predetermined carbon dioxide concentration value.

20 Claims, 4 Drawing Sheets

DIESEL COMBUSTION MODE SWITCHING CONTROL BASED ON INTAKE CARBON DIOXIDE (CO2) CONCENTRATION

CROSS-REFERENCE TO RELATED APPLICATIONS

This application claims the benefit of U.S. Provisional Application No. 60/966,864, filed on Aug. 30, 2007.

This application is related to U.S. patent application Ser. No. 11/466,902 filed on Aug. 24, 2006. The disclosures of the above applications are incorporated herein by reference in their entirety.

FIELD

The present disclosure relates to engine control systems for vehicles, and more specifically to combustion mode control systems for diesel engines.

BACKGROUND

The statements in this section merely provide background information related to the present disclosure and may not constitute prior art.

Diesel engines may be operated in a conventional combustion mode and a Premixed Compression Ignition (PCI) combustion mode. PCI is an advanced diesel combustion technique that may reduce diesel engine emissions. With PCI, fuel is injected into the combustion chamber of the cylinder much earlier in the combustion stroke than would be done for conventional diesel combustion. The desired fuel amount is supplied significantly before the piston reaches the compression top dead center (TDC). The early injected fuel is mixed sufficiently with the air before the piston reaches the compression TDC. Thus, the technique provides a lean and well mixed state of air/fuel mixture before ignition.

A diesel engine may be switched from a conventional combustion mode to PCI combustion mode during low-load operating conditions. Therefore, engine load conditions may be monitored to ensure that the combustion mode is switched to PCI combustion mode at low load conditions. However, switching to PCI combustion mode even at low engine load conditions may result in high NOx emissions without appropriate combustion gas conditions.

Further areas of applicability will become apparent from the description provided herein. It should be understood that the description and specific examples are intended for purposes of illustration only and are not intended to limit the scope of the present disclosure.

SUMMARY

Accordingly, a method of switching a combustion mode of a diesel engine may include determining a carbon dioxide concentration in an intake manifold of a diesel engine, operating the diesel engine in a first combustion mode, and operating the diesel engine in a second combustion mode when the determined carbon dioxide concentration is greater than a predetermined carbon dioxide concentration value.

A control module for switching a combustion mode of a diesel engine may include a carbon dioxide concentration determination module and a combustion mode switching module. The carbon dioxide concentration determination module may be configured to determine a concentration of carbon dioxide in an intake manifold of the diesel engine. The combustion mode switching module may be in communication with the carbon dioxide concentration determination module and may be configured to switch operation of the diesel engine between first and second combustion modes based on the determined concentration of carbon dioxide from the carbon dioxide concentration determination module.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
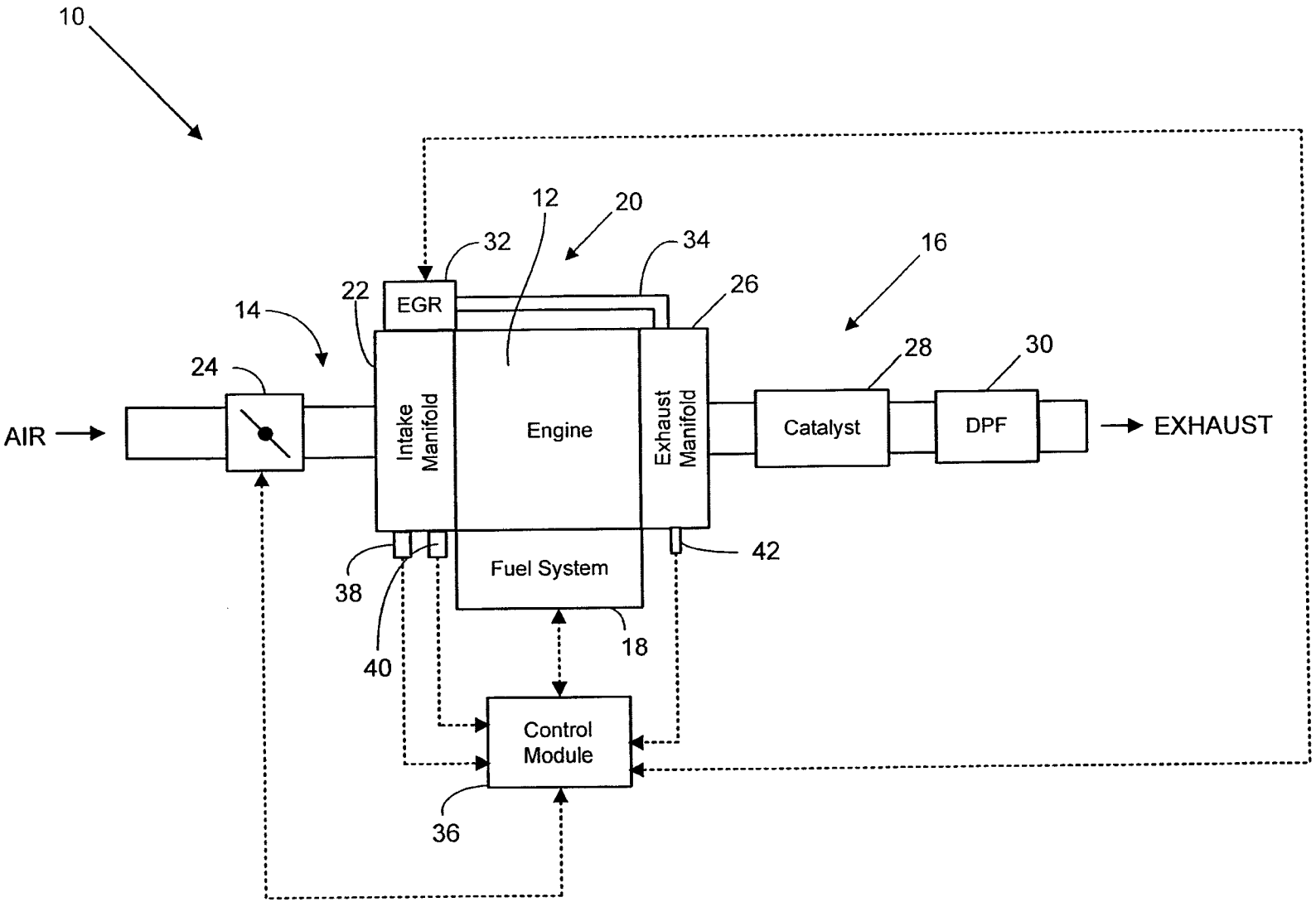
FIG. 1 is a schematic illustration of a vehicle according to the present disclosure.

The following description is merely exemplary in nature and is not intended to limit the present disclosure, application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring to FIG. 1, an exemplary vehicle 10 is schematically illustrated. Vehicle 10 may include a diesel engine 12 in communication with an intake system 14, an exhaust system 16, a fuel system 18 and an exhaust gas recirculation (EGR) system 20. Intake system 14 may include an intake manifold 22 and a throttle 24. Throttle 24 may control an air flow into engine 12 and fuel system 18 may control a fuel flow into engine 12. Exhaust gas created by combustion of the air/fuel mixture may exit engine 12 through exhaust system 16. Exhaust system 16 may include an exhaust manifold 26 in communication with a catalyst 28 and a diesel particulate filter (DPF) 30.

EGR system 20 may provide selective communication between intake system 14 and exhaust system 16. EGR system 20 may include an EGR valve 32 and an EGR line 34. EGR valve 32 may be mounted on intake manifold 22 and EGR line 34 may extend from exhaust manifold 26 to EGR valve 32 providing communication between exhaust manifold 26 and EGR valve 32. Additionally, engine 12 may include a turbocharger (not shown). The turbocharger may be in communication with both the exhaust system 16 and intake system 14. The turbocharger may be driven by the exhaust system 16 and may provide an increased airflow rate to intake system 14.

Vehicle 10 may further include a control module 36 in communication with fuel system 18, throttle 24 and EGR valve 32. Control module 36 may additionally be in communication with a mass air flow (MAF) sensor 38, an intake manifold pressure sensor 40, and an exhaust manifold pressure sensor 42.

MAF sensor 38 provides a signal to control module 36 indicative of the air flow rate into intake manifold 22. Intake manifold pressure sensor 40 provides a signal to control module 36 indicative of the air pressure in intake manifold 22 and exhaust manifold pressure sensor 42 provides a signal to control module 36 indicative of the air pressure in exhaust manifold 26.

Figure 2:
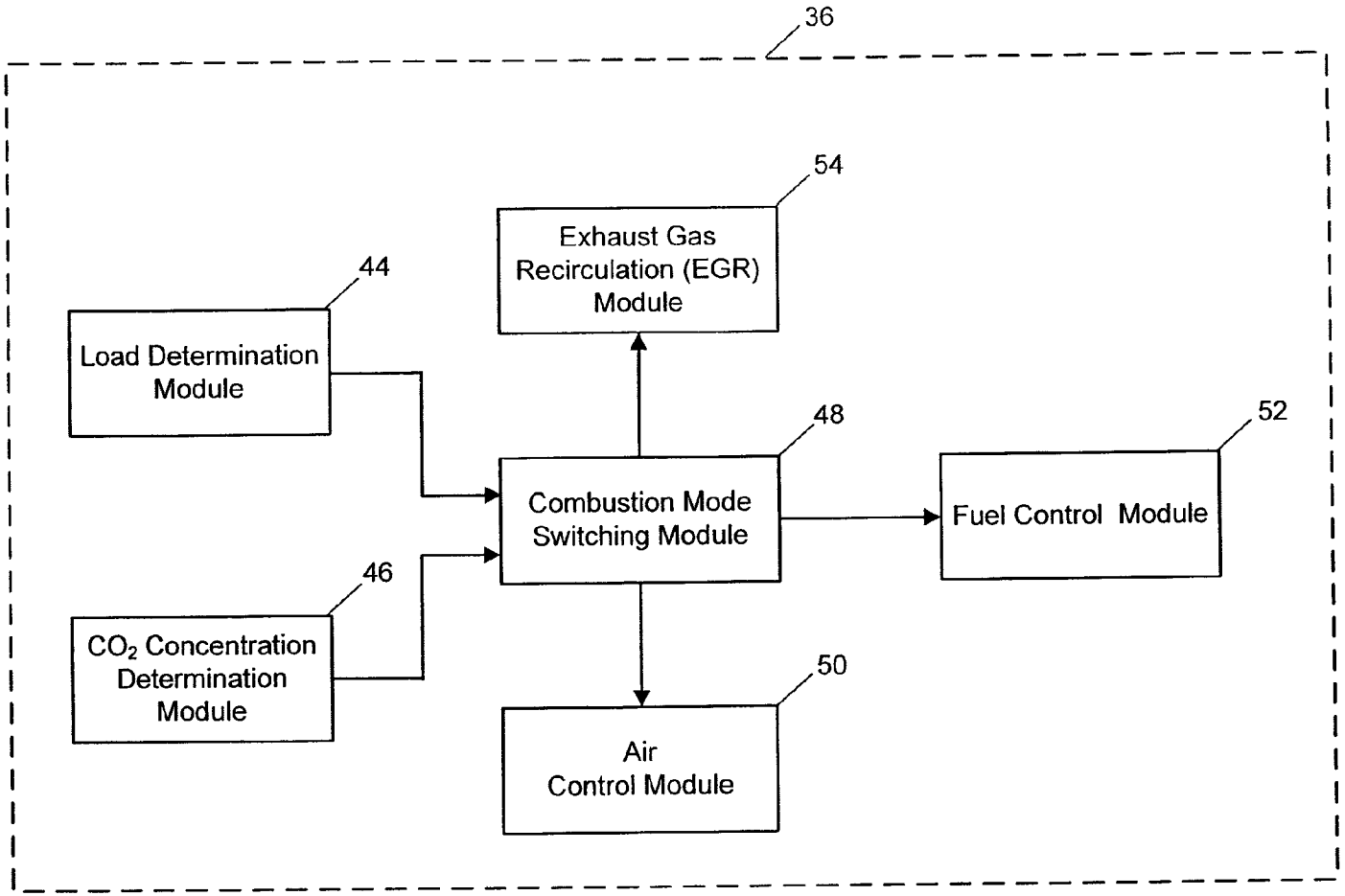
FIG. 2 is a control block diagram of the control module shown in FIG. 1.

FIG. 2 depicts that control module 36 may include a load determination module 44, a carbon dioxide ($CO_2$) concentration determination module 46, a combustion mode switching module 48, an air control module 50, a fuel control module 52, and an EGR module 54. Load determination module 44 may be in communication with combustion mode switching module 48 and may provide information regarding a load on engine 12, as discussed below. $CO_2$ concentration determination module 46 may be in communication with combustion mode switching module 48 and may provide information regarding a $CO_2$ concentration in intake manifold 22, as discussed below. Combustion mode switching module 48 may be in communication air and fuel control modules 50, 52 and EGR module 54, and may provide information regarding the desired combustion mode for operation of engine 12, as discussed below. Air and fuel control modules 50, 52 may control the mass air flow and fuel injection into engine 12 based on the operating combustion mode of engine 12. EGR module 54 may control an amount of exhaust gas flow provided to intake manifold 22 based on the operating combustion mode of engine 12.

Figure 3:
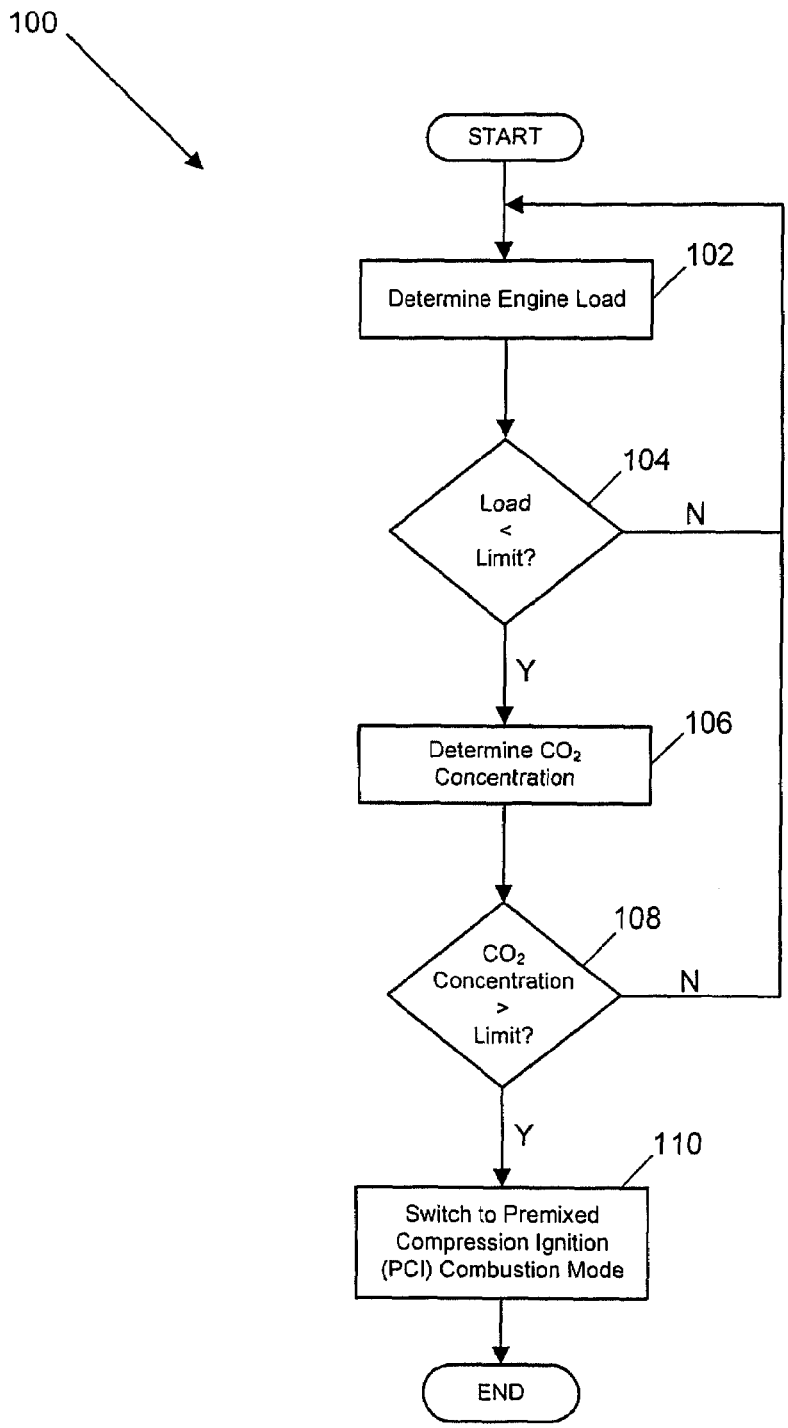
FIG. 3 is a flow diagram illustrating steps for determining switching from a conventional diesel combustion mode to a PCI combustion mode according to the present disclosure.

FIG. 3 depicts a control logic 100 for switching from a conventional diesel combustion mode to a PCI combustion mode. Control logic 100 may begin at determination block 102 where an engine load is determined by load determination module 44. The engine load may generally be based on an engine speed and an amount of fuel injected into engine 12. Once the engine load is determined, control logic 100 may proceed to decision block 104. Decision block 104 evaluates whether the determined engine load is below a predetermined limit using combustion mode switching module 48. If the determined engine load is less than the predetermined limit, control logic 100 proceeds to determination block 106. However, if the load is not below the predetermined limit, engine 12 may not switch to PCI combustion mode, and control logic 100 returns to determination block 102.

Determination block 106 determines the $CO_2$ concentration in intake manifold 22 using $CO_2$ concentration determination module 46. $CO_2$ concentration may be determined in a variety of ways including using a $CO_2$ sensor and calculating a $CO_2$ concentration level. A calculated $CO_2$ concentration may be based on a $CO_2$ concentration in the air entering intake manifold 22, a $CO_2$ concentration in the engine exhaust gas, an EGR percentage, and a fuel quantity supplied to fuel system 18. The EGR percentage may be controlled by EGR module 54 and may be based on the operating combustion mode of engine 12. For example, operation of engine 12 in PCI combustion mode may include a higher EGR percentage than operation in the conventional combustion mode. EGR percentage may generally be defined as the percentage of the total mass flow into engine 12 that EGR accounts for. When operating in PCI combustion mode, EGR percentage may be up to seventy percent. Once the $CO_2$ concentration is determined, control logic 100 proceeds to decision block 108.

Decision block 108 evaluates whether the $CO_2$ concentration is greater than a predetermined limit using combustion mode switching module 48. If the $CO_2$ concentration is greater than the predetermined limit, control logic 100 proceeds to control block 110. However, if the $CO_2$ concentration is not above the predetermined limit, control returns to determination block 102. Control block 110 switches engine 12 from conventional diesel combustion mode to a PCI combustion mode using combustion mode switching module 48. Control logic 100 may then terminate and proceed to control logic 200, as discussed below.

Figure 4:
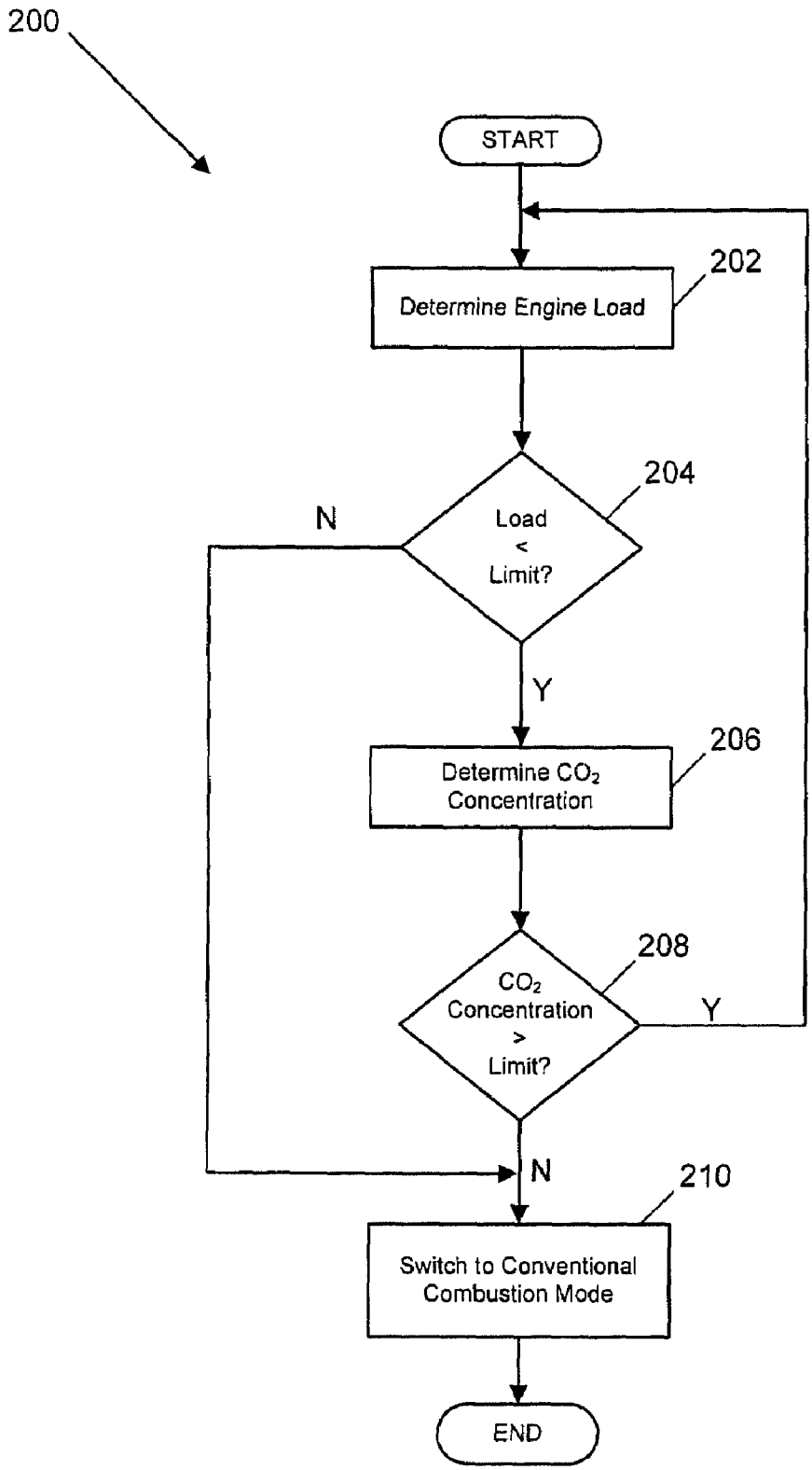
FIG. 4 is a flow diagram illustrating steps for determining switching from a PCI combustion mode to a conventional diesel combustion mode according to the present disclosure.

FIG. 4 depicts a control logic 200 for switching from a PCI combustion mode to a conventional combustion mode. Control logic 200 may begin at determination block 202 where an engine load is determined by load determination module 44. Control logic 200 may then proceed to decision block 204 where the determined engine load is evaluated using combustion mode switching module 48. If the determined engine load is less than a predetermined limit, control logic 200 may proceed to determination block 206. However, if the determined engine load is not below the predetermined limit, control logic 200 may proceed to control block 210, as discussed below.

Determination block 206 may determine the $CO_2$ concentration in intake manifold 22 using $CO_2$ concentration determination module 46, as discussed above. Control logic 200 may then proceed to decision block 208. Decision block 208 determines whether the $CO_2$ concentration is greater than a predetermined limit using combustion mode switching module 48. If the $CO_2$ concentration is greater than the predetermined limit, control logic 200 returns to determination block 202. However, if the $CO_2$ concentration is not greater than the predetermined limit, control logic 200 proceeds to control block 210. Control block 210 switches from PCI combustion mode to conventional combustion mode using combustion mode switching module 48. Control logic 200 may then terminate and proceed to control logic 100, as discussed above.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A method, comprising;

determining a carbon dioxide concentration in an intake manifold of a diesel engine;

operating the diesel engine in a first combustion mode; and operating the diesel engine in a second combustion mode when the determined carbon dioxide concentration is greater than a predetermined carbon dioxide concentration value.

2. The method of claim 1 wherein said operating the diesel engine in the first combustion mode includes operating the engine in a conventional combustion mode.

3. The method of claim 1 wherein said operating the diesel engine in the second combustion mode includes operating the engine in a premixed compression ignition (PCI) mode.

4. The method of claim 1 further comprising determining an engine load and operating the diesel engine in the second combustion mode when the determined engine load is less than a predetermined load value and the determined carbon dioxide concentration is greater than the predetermined carbon dioxide concentration value.

5. The method of claim 4 wherein the determined carbon dioxide concentration is compared to the predetermined carbon dioxide concentration value after the determined engine load is compared to predetermined load value.

6. The method of claim 1 further comprising controlling a mass air flow rate to the engine based on the operating mode.

7. The method of claim 1 further comprising controlling an injection of fuel into the engine based on the operating mode.

8. The method of claim 1 further comprising providing an exhaust gas flow to the intake manifold, wherein said determining a carbon dioxide concentration in the intake manifold includes determining a carbon dioxide concentration in the exhaust gas.

9. The method of claim 8 wherein said determining a carbon dioxide concentration in the intake manifold includes determining an amount of exhaust gas flow to the intake manifold.

10. The method of claim 9 wherein said providing the exhaust gas flow to the intake manifold includes controlling the exhaust gas flow to the intake manifold based on the combustion mode.

11. A control module, comprising:

a concentration determination module that determines a concentration of carbon dioxide in an intake manifold of a diesel engine; and a switching module that switches operation of the diesel engine between first and second combustion modes based on the determined concentration of carbon dioxide.

12. The control module of claim 11 wherein said switching module operates the diesel engine in a conventional combustion mode when the determined concentration of carbon dioxide is less than or equal to a predetermined carbon dioxide concentration value.

13. The control module of claim 11 wherein said combustion mode switching module operates the diesel engine in a premixed compression ignition (PCI) combustion mode when the determined concentration of carbon dioxide is greater than a predetermined carbon dioxide concentration value.

14. The control module of claim 11 further including a load determination module that determines an operating load of the diesel engine, wherein said switching module switches operation of the diesel engine between the first and second combustion modes based on the determined operating load.

15. The control module of claim 14 wherein said switching module switches operation of the diesel engine between the first and second combustion modes when the determined operating load is less than a predetermined engine operating load value and the determined concentration of carbon dioxide is greater than a predetermined carbon dioxide concentration value.

16. The control module of claim 11 further including an air control module that controls a mass air flow rate to the engine based on the combustion mode of the engine.

17. The control module of claim 11 further including a fuel control module that controls an injection of fuel into the engine based on the combustion mode of the engine.

18. The control module of claim 11 wherein said concentration determination module determines a concentration of carbon dioxide in an exhaust gas provided to the intake manifold.

19. The control module of claim 18 wherein said concentration determination module determines an amount of exhaust gas flow provided to the intake manifold.

20. The control module of claim 19 further including an exhaust gas recirculation (EGR) module that controls the amount of exhaust gas flow provided to the intake manifold based on the combustion mode.

* * * * *